US006793379B2

(12) United States Patent
Ward

(10) Patent No.: US 6,793,379 B2
(45) Date of Patent: Sep. 21, 2004

(54) CONFIGURABLE TRACK OR MONOPOINT LIGHT

(75) Inventor: Patrick H. Ward, San Antonio, TX (US)

(73) Assignee: Lucifer Lighting Company, San Antonio, TX (US)

( * ) Notice: Subject to any disclaimer, the term of this patent is extended or adjusted under 35 U.S.C. 154(b) by 12 days.

(21) Appl. No.: 10/285,246

(22) Filed: Oct. 31, 2002

(65) Prior Publication Data

US 2003/0081422 A1 May 1, 2003

Related U.S. Application Data

(60) Provisional application No. 60/334,716, filed on Nov. 1, 2001.

(51) Int. Cl.[7] ..... F21V 21/00

(52) U.S. Cl. ..... 362/371; 362/404; 362/428

(58) Field of Search ..... 362/35, 371, 404, 362/428; D26/63

(56) References Cited

U.S. PATENT DOCUMENTS 2,982,848 A * 5/1961 Rosenberg ..... 362/35
6,511,208 B1 * 1/2003 Kotovsky ..... 362/404

* cited by examiner

*Primary Examiner*—Stephen F. Husar
(74) *Attorney, Agent, or Firm*—Jenkens & Gilchrist, PC

(57) ABSTRACT

A configurable light is built around a central gimbal ring which is attached to a support arm. A bezel ring may be used to attach a variety of light beam altering devices to the front of the gimbal ring. The light source is mounted to the opposite side of the gimbal ring.

6 Claims, 4 Drawing Sheets

CONFIGURABLE TRACK OR MONOPOINT LIGHT

CROSS-REFERENCE TO RELATED APPLICATION

The present application claims the benefit of U.S. Provisional Application for Patent Serial No. 60/334,716, filed Nov. 1, 2001.

FIELD

The present invention pertains to overhead lighting; more particularly, the present invention pertains to a configurable assembly for either a mono point light fixture or an individual track mounted light which will provide a variety of lighting effects and patterns without replacing the monopoint light fixture or the track mounted light.

BACKGROUND

Track mounted and specialty monopoint overhead lights have become very popular for many years because of their low cost, their versatility, and their decorative appearance. Because both the individual track mounted lights and specialty monopoint lights are positionable at a variety of different positions along a track, on a wall, or on a ceiling, a variety of different lighting effects may be obtained by positioning the lights and then moving the head of each individual light to position the emitted light beam to obtain the desired lighting effect on a target. For example, paintings, statues, or store displays may be selectively illuminated.

While moving the individual track or specialty monopoint overhead light assemblies and simply positioning the emitted light beam is acceptable for a variety of circumstances, there are other circumstances where an entirely different fixture must be used to obtain a desired specialty lighting effect. Such specialty lighting effects are often needed in stores to provide lighting accents for displays of featured products.

When special, complicated, or unique lighting patterns are required, the individual track or monopoint overhead lighting fixture or fixtures which are incapable of providing a desired illumination pattern must be removed and physically replaced with one or more fixtures which can provide the desired lighting effect. For example, if a wall wash fixture is in place and a mini-spot light is needed, the wall wash fixture must be physically removed and then replaced with a fixture capable of producing a small focused light beam. Such fixture replacement procedure is cumbersome and expensive because the user of the lighting system is required to keep an inventory of those fixtures needed to obtain all the desired commonly used specialty lighting effects.

There is therefore a need in the art to provide a single track or monopoint overhead lighting fixture which is configurable to provide a wide variety of the commonly used specialty lighting effects; thus obviating the need for keeping an inventory of multiple lighting fixture heads.

SUMMARY

The configurable track or monopoint overhead light of the present invention provides a wide variety of commonly used specialty lighting effects.

Central to the configurable track or monopoint overhead light of the present invention is a gimbal ring. The gimbal ring is pivotably connected to a support member which either connects the track light to the track or the monopoint light to a wall or ceiling. Mounted to the front side of the gimbal ring is a bezel which permits the insertion of a wide variety of light pattern altering hardware. On the opposing side of the gimbal ring, a light source is positioned with appropriate mounting hardware to include a spring bias.

When it is desired to modify the light beam emitted by the configurable track or monopoint overhead light of the present invention, the user simply turns the threaded fastener which holds the configurable light together. With the configurable light disassembled, the appropriate light pattern altering hardware such as shields, reflectors, beam shapers, screens, filters, or lenses are positioned over the front side of the gimbal ring. While the configurable light of the present invention is disassembled, a light source having the desired color and intensity may be inserted. By connecting the light source mounting hardware and the light pattern altering hardware to the gimbal ring, a track or monopoint overhead lighting fixture which produces the desired lighting effect may be created. By pivoting the gimbal ring with respect to the support member, the emitted light may be positioned to illuminate the desired target.

DESCRIPTION OF DRAWING FIGURES.

A better understanding of the configurable track or monopoint overhead light of the present invention may be had by reference to the drawing figures, wherein.

DESCRIPTION OF THE EMBODIMENTS

Figure 1:
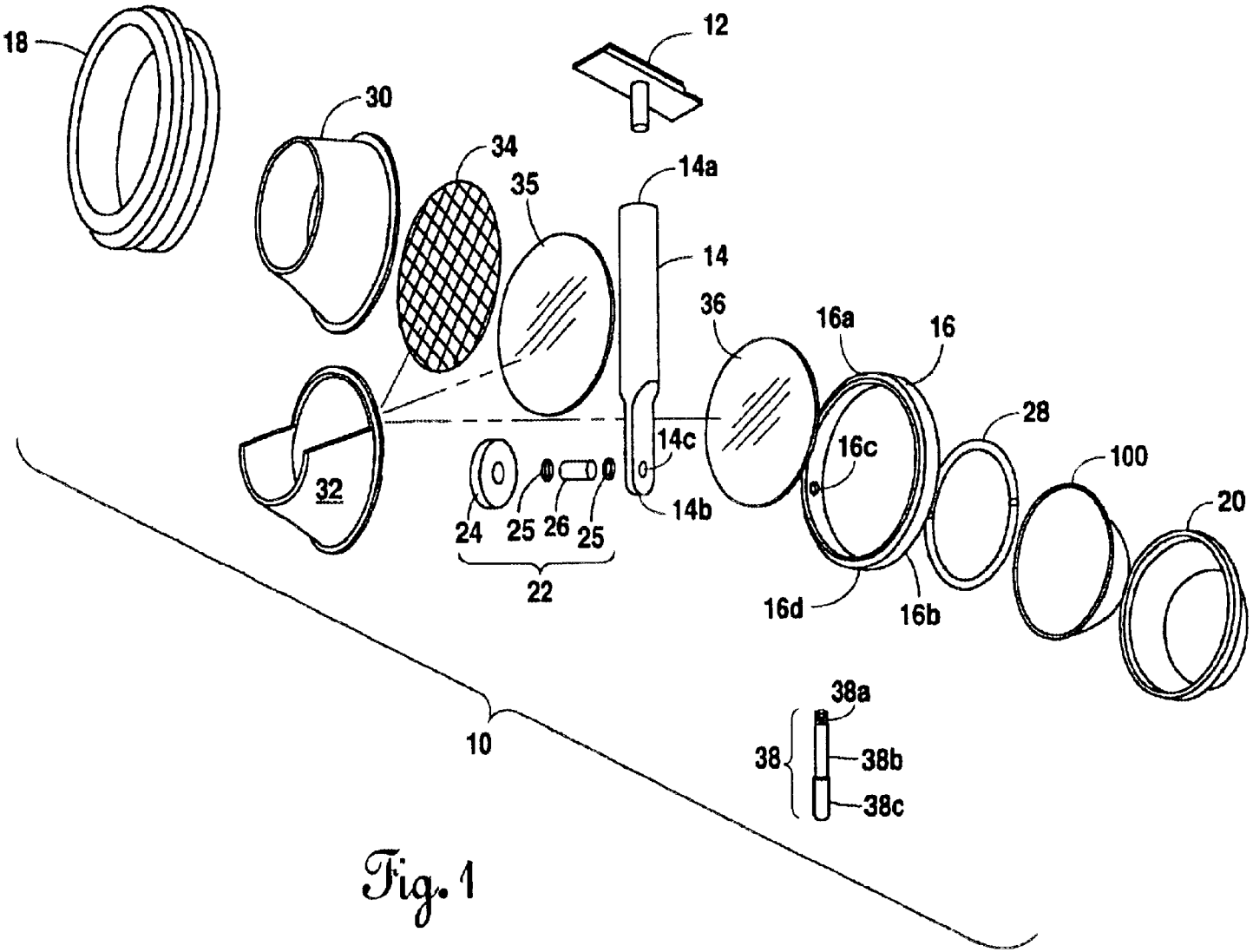
FIG. 1 is an exploded view illustrating the assembly of the configurable track or monopoint overhead light.

As may be seen in FIG. 1, the configurable light of the present invention includes a track adapter 12. If used as a monopoint light, no track adapter 12 is required. To facilitate track mounting, the track adapter 12 is constructed to both mechanically attach the configurable light to the track and provide electrical power to the lamp 100. Those of ordinary skill in the art will understand that various different sizes and shapes of lamps may be used. Depending from the track adapter 12 or extending from a monopoint mounting is a support member 14. As shown in FIG. 1, the top end 14*a* of the support member 14 includes an opening which attaches either to an extension from the track adapter 12 or an extension from a fixed monopoint mounting. On the second or opposite end 14*b* of the support member is located a threaded hole 14*c*. The threaded hole is aligned with a threaded side hole 16*c* in the gimbal ring 16. It is the gimbal ring 16 which provides for the mounting of the various different accessories which enable the customization of the configurable light of the present invention. Affixing the gimbal ring 16 to the support arm 14 through the threaded hole 14*c* is a position tightening assembly 22. The position tightening assembly includes a threaded pin 26 and a turning knob 24. On either side of pin 26 are located washers 25. By loosening of the position tightening assembly, the angular position of the gimbal ring may be adjusted with reference to the support member 14 to direct the light emanating from the lamp 100 in any desired direction.

On the front side 16*a* of the gimbal ring may be placed a variety of different light beam altering devices which are rotationally positionable and secured in place by the interfitment of the bezel ring 18 with the gimbal ring 16. As shown in FIG. 1, a frustoconical beam shaper 30 may be optionally used when a circular light beam is desired. In addition, a screen 34 may be used. If desired, a filter 35 may be used, or a lens 36 may be used. Also shown in FIG. 1 is a partial frustoconical beam shaper 32 which may be used in place of the frustoconical beam shaper 30. An internal reflective surface 33 on the inside of the partial frustoconical beam shaper 32 may be used to modify the light pattern on the illumination target. Other attachments may also be used, such as a beam shaper which, while circular in shape to mount against the bezel ring, progresses to form a rectangular window to provide a rectangular light beam for illuminating a rectangular painting or oblong sculpture.

On the rear side 16*b* of the gimbal ring is located a positioning or biasing ring 28 which provides an interface between the lamp 100 and the bezel ring. Holding the lamp in position is a back cover 20. Alternatively, a spring bias may be placed between the lamp 100 and the back cover 20. At the bottom of the gimbal ring is a threaded hole 16*d* into which may be inserted a wand 38 which includes a top threaded portion 38*a*, a body 38*b*, and a gripped portion 38*c*. Those of ordinary skill in the art will understand that gripped portion 38*c* may be replaced with a standard type head used with a threaded fastener such as a Phillips head or a socket head. Because of the adaptability of the present design, a wide variety of lighting effects may be obtained from the present invention, as described in the following paragraphs.

Figure 2:
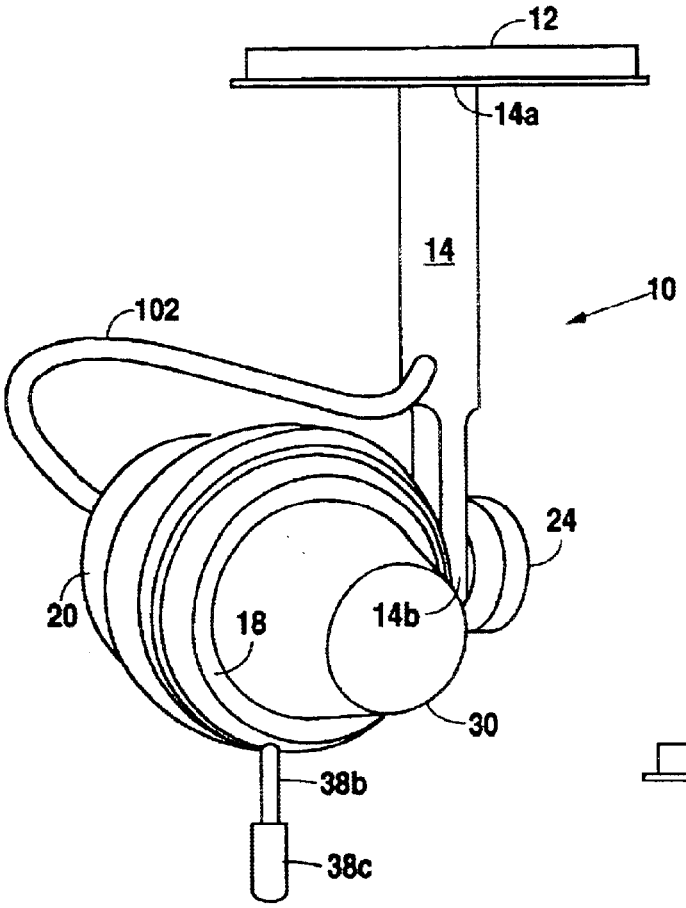
FIG. 2 is a perspective view including an optional beam shaper.

For example, in FIG. 2, the configurable track light 10 of the present invention is configured to include a frustoconical beam shaper 30 to provide a circular illumination pattern. By changing the geometry of the frustoconical beam shaper 30, anything from a pinpoint light to a large circular light beam may be provided. Alternatively, beam shapers may be manufactured to provide light beams of any desired shape, from narrow bands to multi-sided polygons, or to provide light beams having unusual, irregular, or asymmetrical shapes.

Figure 3:
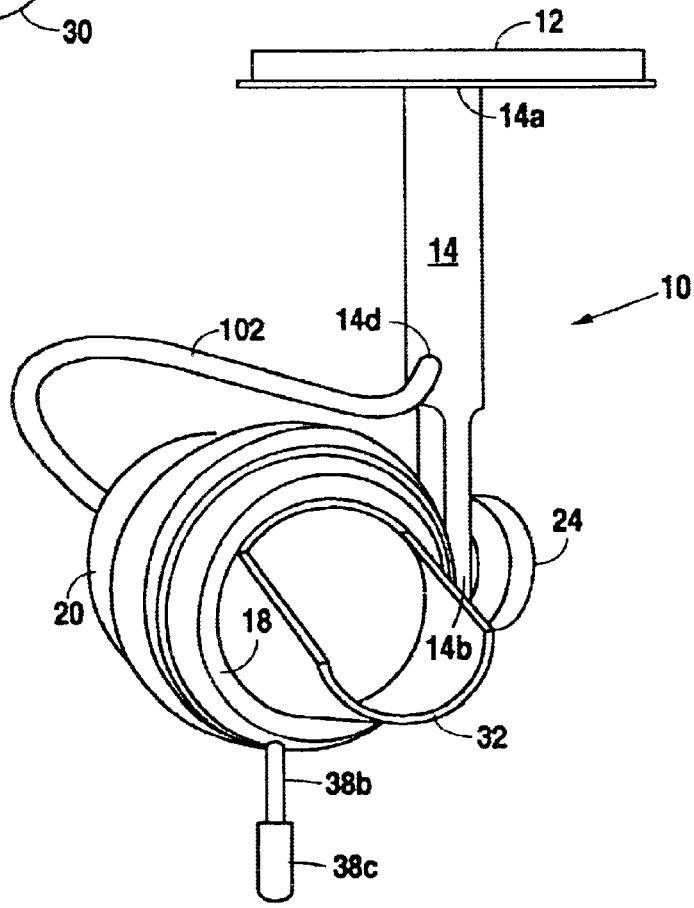
FIG. 3 is a perspective view including a partial beam shaper.

In FIG. 3, the configurable track light 10 of the present invention is configured to include a partial frustoconical beam shaper 32 to provide a fan pattern. The size of the fan is controlled by the size and shape of the side opening in the beam shaper 32, the length of the beam shaper, and the reflective and angle characteristics of the inner surface 33 of the beam shaper 32.

Figure 4:
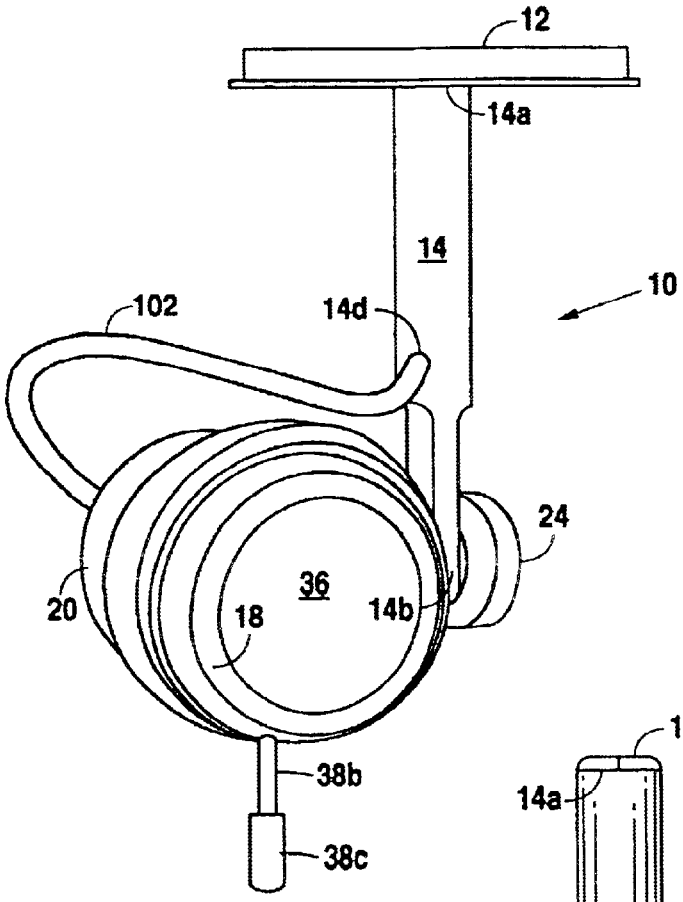
FIG. 4 is a perspective view without any light pattern altering hardware.
Figure 5:
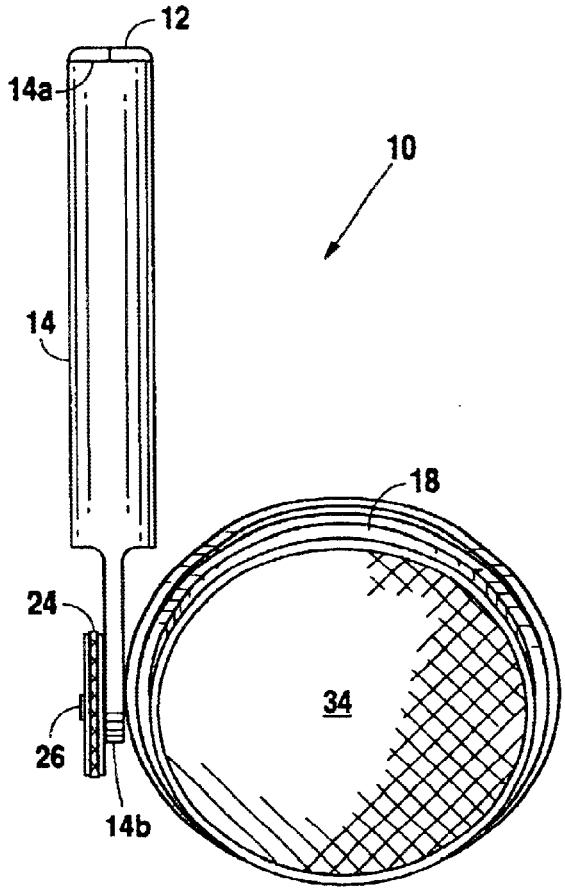
FIG. 5 is a front elevational view without a beam shaper but including an optional screen.

In FIG. 4, the configurable track light does not include any light pattern altering hardware. Those of ordinary skill in the art will understand that any combination of lenses, filters, screens, beam shapers, reflectors, etc. may be used to alter color, dispersion, or intensity of the light beam itself. For example, a screen such as shown in FIG. 5 may be included to provide a specialty effect. The connection between the bezel and the gimbal ring provides for the attachment of a wide variety or combination of beam shapers, lenses, filters, screens, etc., over the light beam emanating from the lamp 100.

Figure 6:
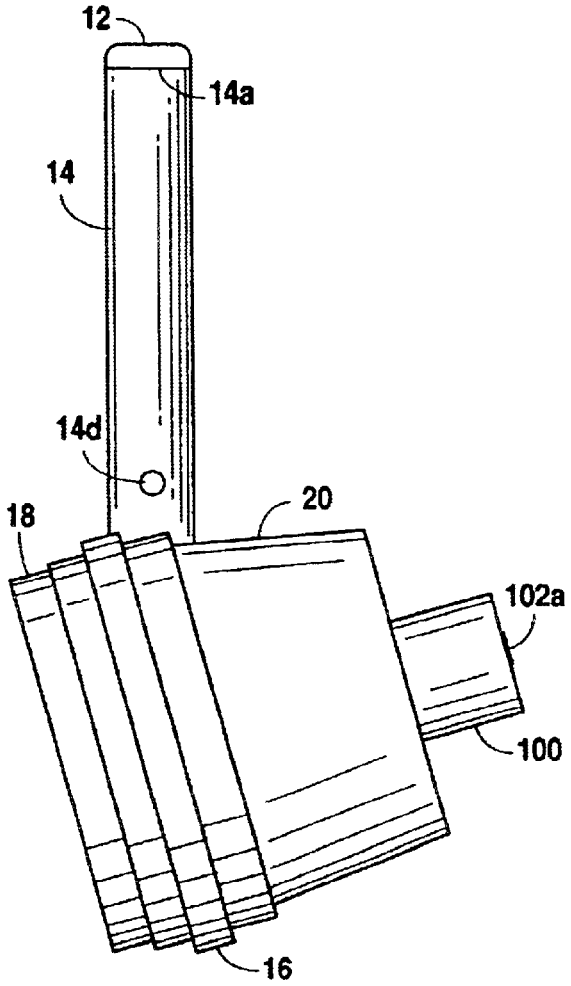
FIG. 6 is a right side elevational view of the embodiment shown in FIG. 4.
Figure 7:
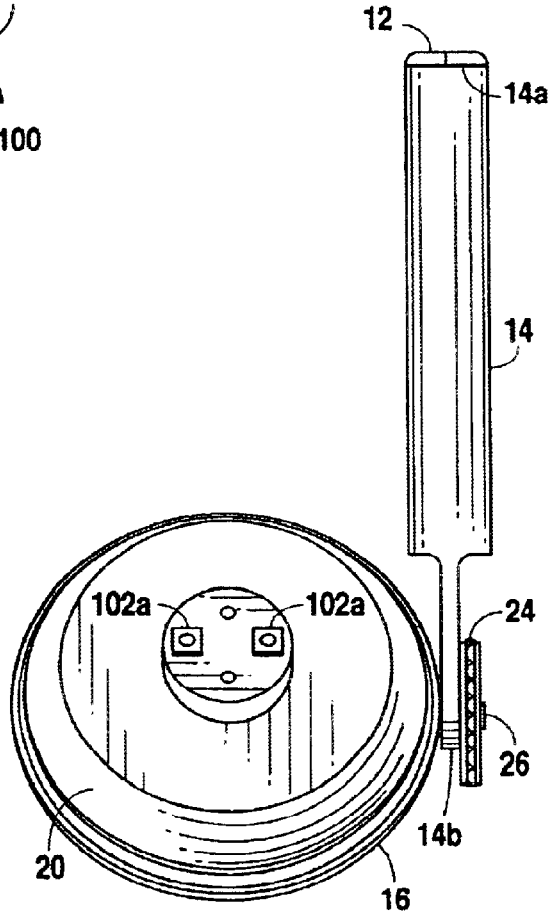
FIG. 7 is a rear elevational view of the embodiment shown in FIG. 4.

As may be seen in FIGS. 6 and 7, that portion of the lamp 100 including the connection for electrical power may be exposed. Alternatively, it may be enclosed. When the configurable track light of the present invention is disassembled, a variety of different light sources may be placed therein. By selecting light sources which produce various types of light beams, a wide variety of lighting effects can be obtained.

It will be understood by those of ordinary skill in the art that the configurable track lighting fixture has been described by reference to its preferred and alternate embodiments. Other embodiments enabled by the foregoing disclosure shall be included within the scope and meaning of the appended claims.

What is claimed is:

1. A configurable light comprising:

a vertical support member including an upper end and a lower end;

a gimbal ring having a front side and a rear side;

said gimbal ring constructed and arranged to be pivotably mounted to said upper end of said vertical support member;

a bezel ring constructed and arranged to be rotationally mounted to said front side of said gimbal ring;

means for supporting a lamp constructed and arranged to be mounted to said rear side of said gimbal ring; and means for modifying light rays being selectively rotatably positionable when mounted between said bezel ring and said gimbal ring.

2. The configurable light as defined in claim 1 wherein said means for supporting a lamp is a housing.

3. The configurable light as defined in claim 1 wherein said means for modifying light rays are selected from a group including a beam shaper, a reflector, a screen, a lens, and a filter.

4. A method of configuring a light to produce a variety of patterns of emitted light, said method comprising the steps of:

pivotably attaching a support member to a gimbal ring;

rotatably mounting at least one device for altering the characteristics of a light beam in a selected position between one side of said gimbal ring and a bezel ring; and mounting a light source to a second side of said gimbal ring.

5. The method as defined in claim 4 wherein said at least one device for altering the characteristics of a light beam is selected from a group including a beam shaper, a reflector, a screen, a lens, and a filter.

6. The method as defined in claim 4 wherein said step of mounting a light source to a second side of said gimbal ring includes positioning said light source in a housing.

* * * * *